US005899352A

United States Patent [19]

Guarda et al.

[11] Patent Number: 5,899,352

[45] Date of Patent: May 4, 1999

[54] ARRANGEMENT FOR A CAN WITH DISCHARGE UPPER OPENING

[75] Inventors: Manoel José Guarda; Pedro Bruni Labate, both of São Paulo, Brazil

[73] Assignee: Brasilata S/A. Embalagens Metalicas, Sao Paulo, Brazil

[21] Appl. No.: 08/971,802

[22] Filed: Nov. 17, 1997

Related U.S. Application Data

[63] Continuation of application No. 08/586,654, filed as application No. PCT/BR95/00027, Apr. 28, 1995, abandoned.

[30] Foreign Application Priority Data

May 3, 1994 [BR] Brazil ..... MU 7400485-9

[51] Int. Cl.[6] ..... B65D 39/00

[52] U.S. Cl. ..... 220/254; 220/790; 220/702

[58] Field of Search ..... 220/254, 790, 220/789, 794, 601, 615, 619, 620, 621, 634, 699–702

[56] References Cited

U.S. PATENT DOCUMENTS

| | | | |
|---|---|---|---|
| 826,215 | 7/1906 | Allyn | 220/794 X |
| 1,022,074 | 4/1912 | Graham | 220/789 |
| 2,074,231 | 3/1937 | Meacham | 220/794 X |
| 3,347,408 | 10/1967 | Baker, Sr. | 220/789 |
| 3,799,388 | 3/1974 | Knize | 220/619 X |
| 3,878,963 | 4/1975 | Knize | 220/620 X |
| 3,923,195 | 12/1975 | Wallace | 220/789 |
| 4,171,063 | 10/1979 | Cloutier | 220/789 |
| 4,180,179 | 12/1979 | Hoenig et al. | 220/794 X |

FOREIGN PATENT DOCUMENTS

| | | | |
|---|---|---|---|
| 682353 | 3/1964 | Canada | 220/620 |
| A-0 292 462 | 11/1988 | European Pat. Off. . | |
| 283274 | 11/1952 | Switzerland | 220/620 |
| 150333 | 6/1955 | Switzerland | 220/620 |
| WO-A-81 00994 | 4/1981 | WIPO . | |
| WO-A-95 03225 | 2/1995 | WIPO . | |

*Primary Examiner*—Stephen K. Cronin
*Assistant Examiner*—Nathan Newhouse
*Attorney, Agent, or Firm*—Darby & Darby

[57] ABSTRACT

A can has a flange extending inwardly from its vertical wall and has a downwardly extending lateral wall that defines an opening, and the free lower end of said lateral wall has a first rib therearound of open tubular shape of part of a circle. A lid for fitting into and sealing the can opening has a lateral wall therearound with a second rib at its free upper end to engage the can flange, a central wall portion below the second rib to engage the flange lateral wall that defines the opening, and a recess therearound below the central portion having the shape of part of a circle corresponding to that of the can first rib. The can first rib fits into the recess in an engaging interference fit.

9 Claims, 3 Drawing Sheets

ARRANGEMENT FOR A CAN WITH DISCHARGE UPPER OPENING

This is a continuation of application Ser. No. 08/586,654, filed Dec. 29, 1995 now abandoned which is a 371 of PCT/BR95/00027 filed on Apr. 28, 1995.

FIELD OF THE INVENTION

The present invention refers to cylindrical or parallelepipedal cans, provided with a discharge opening, which occupies a substantial portion of the area of the can upper wall. More particularly, the present invention refers to an improvement at the upper wall of said cans.

BACKGROUND OF THE INVENTION

The cylindrical or parallelepipedal cans, which are used for storing bulk products, have at their upper wall an opening occupying a large area. The closing of said cans is achieved by applying a lid onto said opening, in order to avoid loss of the content stored inside the can, regardless of the position of said cans. Such lids have a reinforced peripheral edge, in order to prevent said lids from suffering damages during the opening of the can, which may avoid said opening. This reinforcement is calculated to give more strength to the lid.

In a known construction, the peripheral edge of the lid is seated against a corresponding closing seat, which is defined at the edge of the central opening and which is projected onto an upper wall portion of said can, said portion being disposed at a lower plane in relation to the plane of the reinforced peripheral edge of the can, thereby allowing said peripheral edge to act as a supporting point for the application of a lever used to remove said lid during the opening of the can.

In the Brazilian Utility Model Application MU 7301199, of the same applicant, a new construction is described for the upper wall of the cans provided with discharge openings, in which the lid is seated against a corresponding closing seat, defined at an annular step provided at the internal peripheral edge of the upper wall, said step being positioned at the lower portion of a median annular region of the upper wall that is located radially between said step and the external edge of said upper wall.

In these constructions, the internal edge of the upper wall has, at the region where the closing seat is defined, a tubular wall portion, which is downwardly projected towards the inside of the can, and which terminates in a free end in contact with the content of the can and with a lid wall portion, radially projecting beyond said end, in order to cause the locking of the lid to the can when the lid is seated onto the closing seat of the discharge opening of said can.

An inconvenience of said tubular wall constructions refers to the possibility of the stored product being contaminated by the contact thereof with the radial internal face of the free end of the tubular wall, which face is not varnished as the can inside, thus allowing the occurrence of oxidation and the above cited contamination of the product. This oxidizing contact, in the case of liquid products, results from a film of this liquid that remains between the adjacent contact surfaces of the tubular wall of the central opening and the annular wall of the lid. The film between said surfaces results from the absence of restriction to the access of the liquid to the can opening region.

Another inconvenience of these constructions refers to the fragile lid-central opening closing, in which the locking is obtained only by fitting an annular portion of the lid tubular wall, which has a diameter slightly larger than that of the central opening free end and which acts against the latter when said lid is removed. To permit the closing and opening movements of the can, said annular portion is elastically deformed from a locking position to a retracted position, said deformation being easily obtained due to the fragile locking, thus allowing the involuntary opening of the can.

A still further inconvenience of these constructions refers to the possibility of the user being hurt when handling the can, due to the fact that the tubular wall of the central opening terminates in a sharp edge.

DISCLOSURE OF THE INVENTION

Thus, it is an object of the present invention to provide an upper wall for cylindrical or parallelepipedal cans, which are provided with a discharge upper opening occupying a large area of said upper wall and being shaped to avoid contamination of the content of the can by said content contacting the non-varnished portions of the can.

Another object of the present invention is to provide an upper wall for the can of the above cited type, which allows a better locking of the lid onto the can, thus making difficult the accidental opening of said can.

A further object of the present invention is to provide an upper wall for the can of the above cited type, which prevents the user from being hurt while handling said can.

These and other objectives of the present invention are achieved by an arrangement for a can with a large discharge upper opening, said cans having an upper wall where there is defined an opening provided with a closing seat, wherefrom a tubular wall having a free end is downwardly projected; a lid having a peripheral edge to be seated onto the closing seat and wherefrom an annular wall is downwardly projected, the free end of the tubular wall being curved towards the inside of the central opening and upwardly, until it reaches a position adjacent to said tubular wall, defining a tubular wall lower edge in the form of a continuous rib.

BRIEF DESCRIPTION OF THE DRAWINGS

The invention will be described below, with reference to the attached drawings, in which.

BEST MODE FOR CARRYING OUT THE INVENTION

Figure 1:
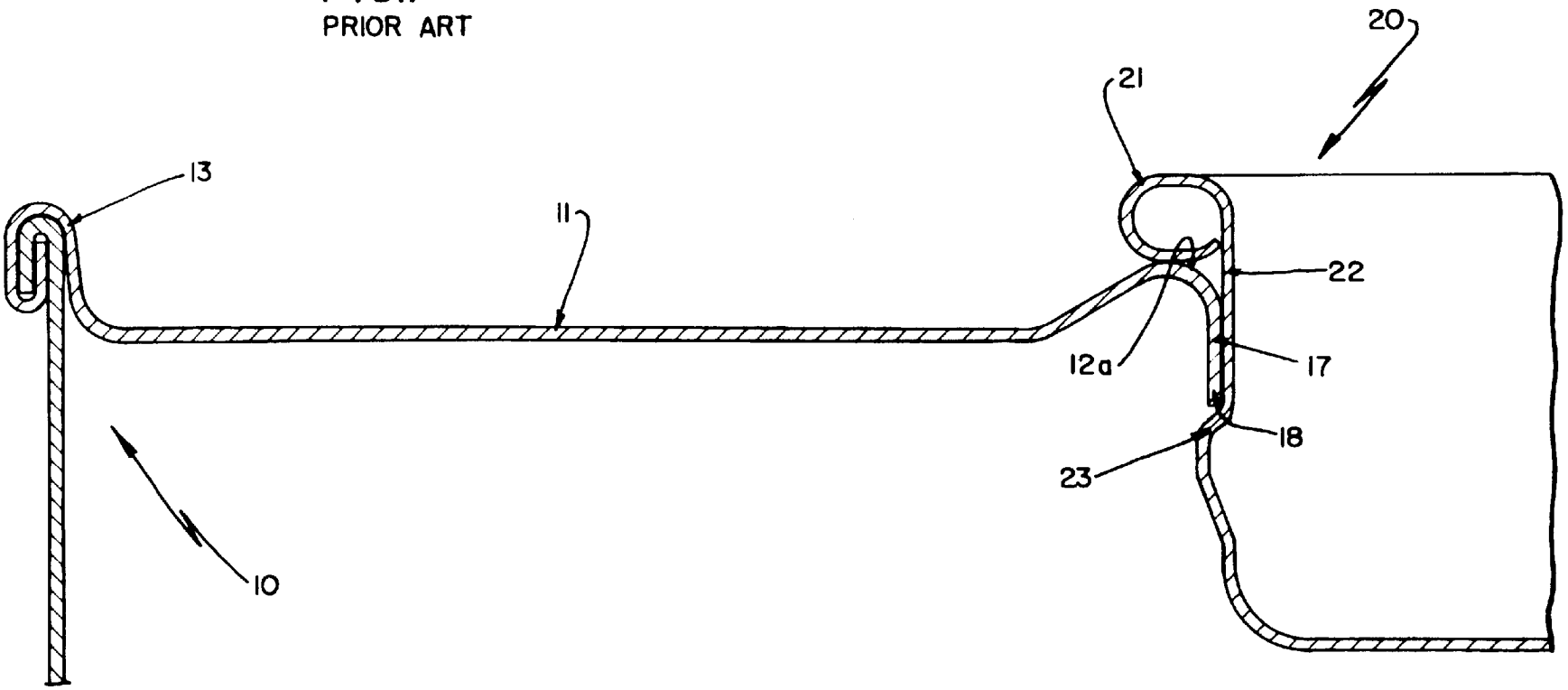
FIG.1 PRIOR ART
FIG. 1 is a partial cross sectional view of the upper wall of a can with a large discharge upper opening, according to the prior art.
Figure 2:
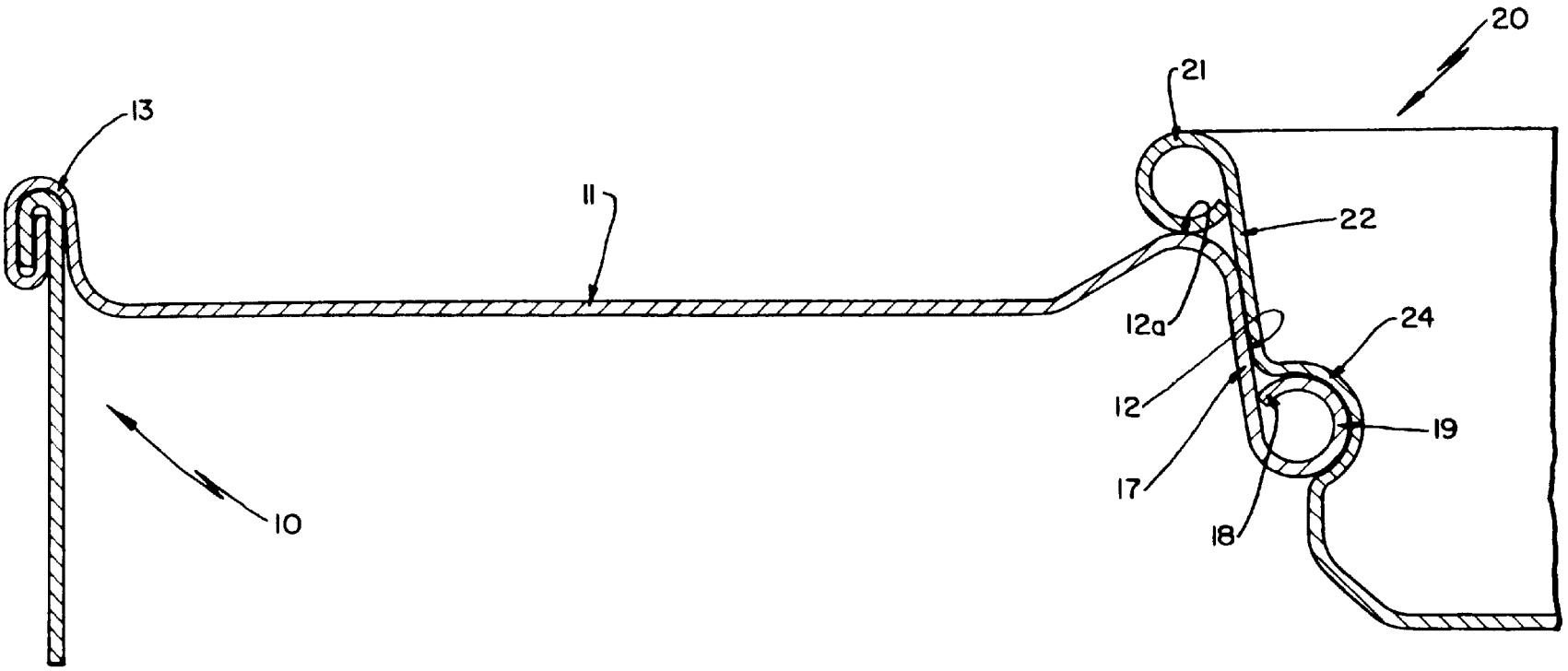
FIG. 2 is a similar view as that of FIG. 1, showing a portion of the can upper wall, according to the present invention.
Figure 3:
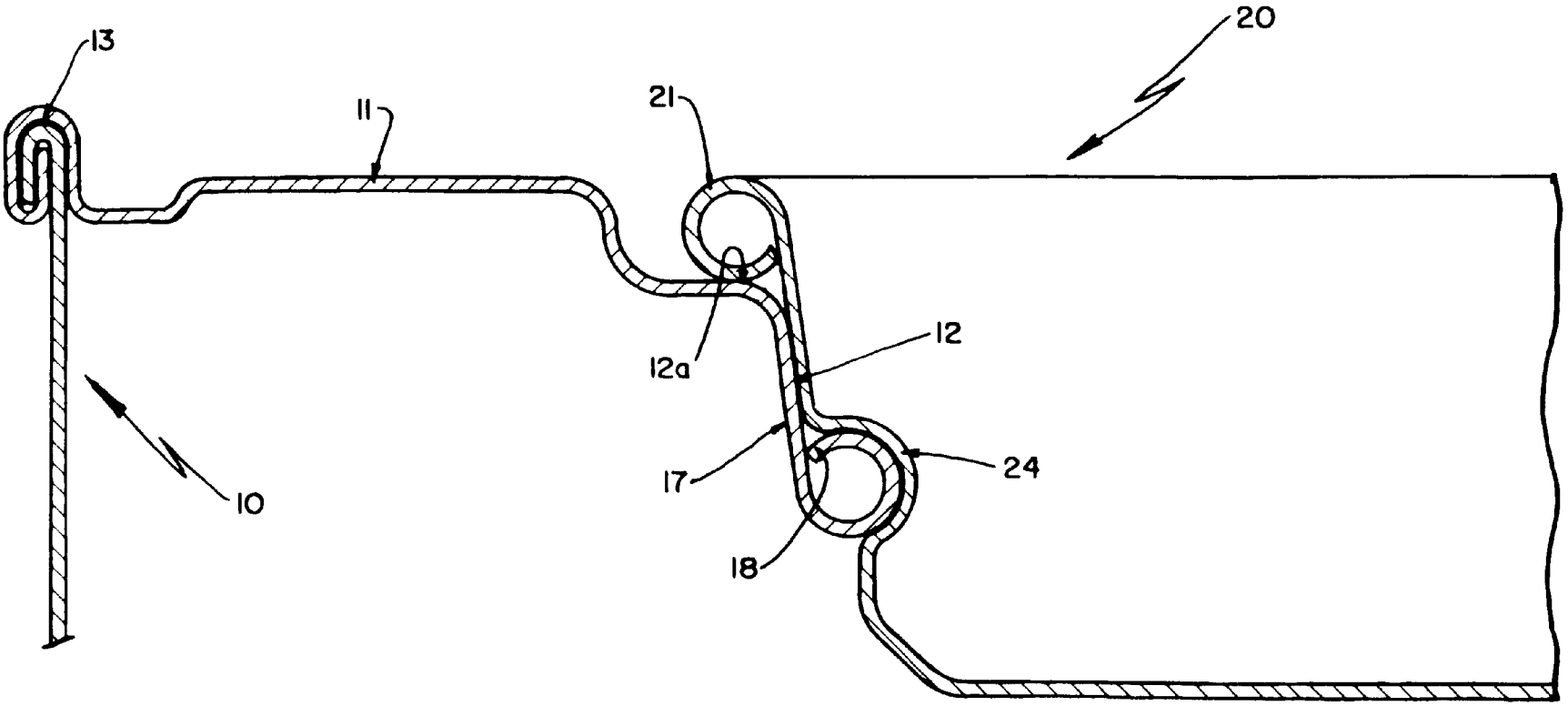
FIG. 3 is a similar view as that of FIG. 2, showing a portion of the can upper wall, according to another embodiment of the present invention.

According to FIGS. 1, 2 and 3, a can 10 is provided, at its discharge upper wall 11, with a discharge opening 12, which is substantially circular, which occupies a substantial part of the total area of the respective upper wall 11 and which is closed by a lid 20, said closing being obtained by seating a peripheral edge 21 of said lid 20 onto a closing seat 12*a*, defined at the central opening 12 of the upper wall 11. Though it is illustrated an opening with a substantially circular shape, the discharge opening may have any oval or polygonal shape.

According to the illustration in FIG. 1, the central opening 12 of the upper wall 11 is provided, at the closing seat 12*a*, with a tubular wall 17, which is downwardly projected towards the inside of the can 10, in a substantially rectilinear way and orthogonal to the surface of the upper wall 11, said tubular wall 17 defining the contour of the central opening 12 for the introduction of the lid 20 and acting on the latter to maintain its closing condition after the peripheral edge 21 of said lid 20 has been seated onto the closing seat 12*a* of the central opening 12. The tubular wall 17 has a free end 18, forming a sharp peripheral edge which retains the lid 20 in the closing condition. In this construction, the central opening 12 is spaced from the external peripheral edge 13 by a flat upper wall portion, which is lowered in relation to said external peripheral edge 13 and closing seat 12*a*. Another construction for the upper wall 11 is illustrated in FIG. 3 and discussed in the Brazilian Utility Model Application MU 7301199 of the same applicant.

The lid 20 of the prior art has a rounded peripheral edge 21, wherefrom there is projected an annular wall 22, which is resilient and substantially vertical and which, when the lid 20 is applied onto the can 10, is kept in contact by radial pressure with the axial annular wall 17 of the central opening 12. In order to lock the lid 20 to the can 10, said lid 20 is provided, at a lower portion of its annular wall 22, with a diametral widening, defining a step 23 external to said wall and spaced from the peripheral edge 21 of the lid 20, so that, in the closing condition of the can 10, said step 23 acts against the free end 18 of the tubular wall 17 of the central opening 12, thus making difficult the involuntary removal of the lid 20 in relation to the can 10, but presenting all the inconveniences mentioned above.

According to the present invention illustrated in FIGS. 2 and 3, the tubular wall 17 of the central opening 12 is provided with a lower portion, which is curved towards the inside of the central opening 12 and then curved upwardly, so that the free end 18 of the tubular wall 17 reaches a portion of said tubular wall 17, defining a tubular wall lower edge in the form of a continuous peripheral rib 19, preferably tubular and spaced from the closing seat 12*a*.

According to a preferred illustrated form, the bending of the lower portion of the tubular wall 17, that is, the tubular rib 19, defines a retaining body that avoids the voluntary removal of the lid 20, after said lid has been seated onto the central opening 12. In another solution, not illustrated, the peripheral rib 19 is tangent to a plane containing the closing seat 12*a* and orthogonal to the upper wall 11, thus not requiring any modification in the shape of the lid 20.

According to the preferred illustrated construction of the peripheral rib 19, the lid 20 of the present invention comprises, at its portion of annular wall 22 away from the peripheral edge 21, a peripheral recess 24, preferably annular and continuous, of a substantially circular shape and matching with the shape of the peripheral edge 19, which fits into said recess when the lid 20 is positioned on the central opening 12 of the can 10 in order to close the latter. The provision of the peripheral rib 19 in the central opening 12, as well as the diametral recess in the lid 20 allows to achieve a closing with a locking effect that avoids the involuntary opening of the can 10. Moreover, the construction of the rib prevents the user from being hurt while handling the can and avoids the contamination of the product by said product contacting the non varnished regions of the can 10, since said rib provides an obstacle to the formation of liquid film between the adjacent external contact surfaces of the tubular wall 17 of the central opening 12 and the annular wall 22 of the lid 20.

In order to obtain the closing of the can 10, according to the preferred illustrated construction, the introduction of the lid 20 into the central opening 12 of said can 10 causes an elastic deformation in at least one of the parts defined by the tubular wall 17 of the central opening 12 and annular wall 22 of the lid 20, due to the presence, at the central opening 12, of the peripheral rib 19, the deformation caused during the closing of the can 10 being achieved, until the peripheral recess 24 of the lid 20 fits into said peripheral rib 19. In this condition, the peripheral edge 21 of the lid 20 is seated onto the closing seat 12*a* of the central opening 12, this situation being only interrupted by the voluntary introduction of an element that, when disposed between said peripheral edge 21 and closing seat 12*a*, forces said parts to mutually separate, initiating an elastic deformation thereof, in order to separate the peripheral edge 19 from the peripheral recess 24.

We claim:

1. A combination comprising:

a can having a flange extending inwardly from a vertical wall of said can, said flange having a downwardly extending lateral wall defining an opening, a lower section of said lateral wall being continuously curved towards the inside of said can opening and upwardly and around back toward said lateral wall with a free end facing and opposing the inside of said lateral wall to form a first rib of open tubular shape of a substantial part of a circle around a lower end of said flange lateral wall;

a lid for fitting into and sealing said can opening, said lid having a lateral wall therearound with an end of an upper section of said lid lateral wall being continuously curved downwardly and around back toward the outside of said lid lateral wall with a wall free end facing and opposing the outside of said lid lateral wall to form a second rib of open tubular shape of a substantial part of a circle having a curved portion to engage a top of said can flange, a central wall portion below said second rib to oppose said flange downwardly extending lateral wall above said can first rib, and a diametral recess around said lid lateral wall below said central wall portion and inwardly of said central wall portion having a shape of a substantial part of a circle substantially matching the shape of said can first rib, said can first rib fully fitting into said lid recess with a substantial portion of the circular part of said first rib in an engaging interference fit with substantially the entire outer surface of said circular recess to form a lock between said lid and said can flange and to seal the contents in said can from entering between the opposing lid central wall portion and said flange downwardly extending lateral wall, and said lid second rib engaging said can flange, downward force on said lid moving the wall free end of said lid second rib toward said lid lateral wall.

2. The combination as in claim 1 wherein said central portion of said lid lateral wall and a part of said can lateral wall above said first rib that said lid central portion opposes are flat.

3. The combination of claim 1 wherein said can lateral wall depends generally transversely to said can flange and has a section angled inwardly of said opening from said flange to said first rib and said lid lateral wall has a section angled inwardly from said second rib to said recess.

4. The combination of claim 1 wherein said flange has a raised step from which said can lateral wall extends and said curved portion of said lid second rib engages a top of said step.

5. The combination of claim 4 wherein the top of said flange step is curved and said curved portion of said lid second rib engages said step curved top.

6. The combination of claim 1 wherein said flange has a depressed step with a flat portion from which said can lateral wall extends, and said curved portion of said lid second rib rests on said flat portion of said flange depressed step.

7. The combination of claim 6 wherein said flange depressed step is flat.

8. The combination of claim 1 wherein a lowermost section of said lid lateral wall at a lower end of said recess extends downwardly and projects toward said can vertical wall and progressively engages said first circular rib as said lid is moved downwardly into said opening to thereby flex said can lateral wall away from said lid lateral wall and upon further downward movement of said lid, said can lateral wall moves back toward said lid lateral wall and said can circular first rib fully engages into said circular recess upon said lid second rib engaging said can flange.

9. The combination of claim 8 wherein said lowermost section of said lid lateral wall below said flange first rib is generally transverse to said can flange.

* * * * *